US006209380B1

(12) United States Patent
Papazian et al.

(10) Patent No.: US 6,209,380 B1
(45) Date of Patent: Apr. 3, 2001

(54) PIN TIP ASSEMBLY IN TOOLING APPARATUS FOR FORMING HONEYCOMB CORES

(75) Inventors: John M. Papazian, Great Neck; Edwin Gerard Haas, Sayville; Robert Charles Schwarz, Huntington; Jerrell A. Nardiello, Hicksville; John Melnichuk, Bethpage, all of NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/515,084

(22) Filed: Feb. 28, 2000

(51) Int. Cl.[7] ..... B21D 37/00; B21D 47/04
(52) U.S. Cl. ..... 72/413
(58) Field of Search ..... 72/413, 414, 306, 72/312, 466.8, 14.8

(56) References Cited

U.S. PATENT DOCUMENTS

| | | | | |
|---|---|---|---|---|
| 2,280,359 | | 4/1942 | Trudell | 113/44 |
| 2,446,487 | | 8/1948 | O'Kelley | 153/51 |
| 3,081,129 | | 3/1963 | Ridder | 297/452 |
| 4,212,188 | | 7/1980 | Pinson | 72/413 |
| 4,890,235 | | 12/1989 | Reger et al. | 364/468 |
| 4,943,222 | | 7/1990 | Nathoo | 425/89 |
| 4,972,351 | | 11/1990 | Reger et al. | 364/468 |
| 5,151,277 | | 9/1992 | Bernardon et al. | 425/112 |
| 5,187,969 | | 2/1993 | Morita | 72/413 |
| 5,546,784 | * | 8/1996 | Haas | 72/413 |
| 5,738,345 | | 4/1998 | Schroeder et al. | 269/266 |
| 5,796,620 | | 8/1998 | Laskowski et al. | 364/475.02 |
| 5,954,175 | * | 9/1999 | Haas | 72/413 |
| 6,012,314 | * | 1/2000 | Sullivan | 72/413 |
| 6,053,026 | * | 4/2000 | Nardiello | 72/413 |
| 6,089,061 | * | 7/2000 | Haas | 72/413 |

FOREIGN PATENT DOCUMENTS

| | | | | |
|---|---|---|---|---|
| 900654 | * | 7/1962 | (GB) | 72/413 |
| 1-95829 | * | 4/1989 | (JP) | 72/413 |
| 133622 | * | 5/1989 | (JP) | 72/413 |

* cited by examiner

*Primary Examiner*—Daniel C. Crane
(74) *Attorney, Agent, or Firm*—Terry J. Anderson; Karl J. Hoch, Jr.

(57) ABSTRACT

Tooling apparatus for three-dimensionally forming a honeycomb core article includes a die having an array of elongated mutually parallel translating pins, each having a pin tube terminating at a tip end and arranged in a matrix for longitudinal movement between retracted and extended positions. The tip ends of the array of translating pins are engageable with an end surface of the honeycomb core article when in the extended position. Each tip end includes a pin tip assembly including an elongated pin tip member having an outwardly projecting bearing surface of shape conformable material on which is mounted a protective thrust pad, an opposed bottom surface, and an outer peripheral surface extending between the bearing surface and the bottom surface. A cup-shaped retainer having a base and an upstanding wall with an outer peripheral surface is provided for mounting engagement with the tip end of each pin tube and has an internal recess with a base surface and an internal peripheral surface. The pin tip member is mounted on the retainer, the outer peripheral surface of the pin tip member engaged with the internal peripheral surface of the retainer and the bottom surface of the pin tip member engaged with the base surface.

19 Claims, 6 Drawing Sheets

PIN TIP ASSEMBLY IN TOOLING APPARATUS FOR FORMING HONEYCOMB CORES

BACKGROUND OF THE INVENTION

1. Field of the Invention

The present invention relates generally to forming of honeycomb core and, more specifically, to computer-controlled tooling capable of providing an adjustable three dimensional surface for forming honeycomb core articles with the capability of applying or directing heated air or gas through the honeycomb core cells as well as providing rapid contour changes. The mechanism of the invention is comprised of a plurality of assembled modules which act in concert with one another to effect the work operation.

2. Description of the Prior Art

Many types of honeycomb core are traditionally cold or hot press-formed. Core can be hot-formed on a heated press, or oven-heated and formed on a non-heated press, both traditionally using fixed-contour machined or cast dies to impart the needed three dimensional contours to the exterior surfaces. Honeycomb core is also roll-formed and/or contour machined to achieve the desired external contours. Roll forming is generally limited to honeycomb core which has ruled surfaces and cannot be used effectively to produce formed honeycomb core with contours that change in two orthogonal directions, both normal to the direction of the cells. Three-dimensional contours are the most expensive to produce and the tools are not easily adapted to other shapes. Individual three-dimensional contour dies are costly and time consuming to make, and require time and storage space. A cheaper, faster, more adaptable methodology is needed which can be used for a large variety of honeycomb core shapes. The method and hardware should be easily adapted to existing equipment for widespread industry acceptance.

Since the cost for an adjustable forming die is high relative to the cost for fixed-contour dies, the use of discrete tooling should be considered when very few pieces each of a large variety of core details are needed. The converse is generally also true. Formed honeycomb core is generally used in aerospace applications where each aircraft requires a large variety of honeycomb core shapes. Since the economic viability of replacing a honeycomb core forming system using many fixed-contour dies with an adjustable-die system using a single discrete adjustable-contour die depends upon the number of fixed tools that an adjustable die can replace, aircraft manufacturing is well-suited to the discrete, adjustable-tooling approach. Another cost savings from lower labor requirements to fit generically formed core can be realized. Additionally, the referenced modular design approaches allows the plan form of the discrete, adjustable die to be changed inexpensively, if needed to different length/width combinations by adding or subtracting modules mounted to oversize base plates. The tooling has been described in detail in other disclosures referenced in the Appendix, many of which are specifically designed for stretch forming of sheet metal. Nonobvious modifications to previously-disclosed tooling and forming methods are needed however to adapt the prior-disclosed tooling and methods to acceptably form honeycomb core.

Discrete, self-adjusting form tools have the capability to change shape and form honeycomb core very rapidly using computer control. They can store and retrieve contour information for many three-dimensional shapes in the form of data files stored within computer memory. The concept of "modularity" as introduced by U.S. Pat. No. 5,954,175 entitled "Modularized Parallel Drivetrain" and U.S. Pat. No. 6,012,314 entitled "Individual-Motor Pin Module" is suggested for large, reconfigurable form dies. This approach saves money through the use of repetitive low-cost, high quality castings for geartrain or drive motor housings and bases and eases problems with wiring, assembly, troubleshooting, servicing, maintenance, repair and replacement tasks. Since improper movement of just one pin can cause rejection of a finished piece of honeycomb core, rapid repair with minimum downtime is therefore critical. Discrete dies should have the capability to rapidly replace components and assemblies from acceptable spares stock. The use of modular design construction for large dies helps to minimize downtime. The disclosures of the above-referenced applications are hereby incorporated into this disclosure in their entirety by reference.

Also, since honeycomb core is generally press-formed using fixed, three-dimensionally contoured dies, the springback in the honeycomb core cells is largely dependent upon the die shape and partly dependent upon the changing forming temperature of the core, die, press force and timing application. Fixed dies do not have the ability to change their own contour if an improper amount of springback was designed into the final die shape. Nor do fixed-contour dies have the ability to rapidly, accurately, and consistently adapt to engineering changes involving shape. Expensive machining rework and/or extra labor is needed.

Typical of the prior art are U.S. Pat. No. 5,546,784 to Haas et al. which discloses an adjustable form die, U.S. Pat. No. 2,280,359 to Trudell which discloses a forming apparatus with rubber blocks to conform to the mold, and U.S. Pat. No. 3,081,129 to Ridder which discloses a test chair with an array of plungers with rubber end caps.

It was with knowledge of the foregoing that the present invention has been conceived and is now reduced to practice.

SUMMARY OF THE INVENTION

The present invention relates to tooling apparatus for three-dimensionally forming a honeycomb core article. The tooling apparatus includes a die having an array of elongated mutually parallel translating pins, each having a pin tube terminating at a tip end and arranged in a matrix for longitudinal movement between retracted and extended positions. The tip ends of the array of translating pins are engageable with an end surface of the honeycomb core article when in the extended position. Each tip end includes a pin tip assembly including an elongated pin tip member having an outwardly projecting bearing surface of shape conformable material on which is mounted a protective thrust pad, an opposed bottom surface, and an outer peripheral surface extending between the bearing surface and the bottom surface. A cup-shaped retainer having a base and an upstanding wall with an outer peripheral surface is provided for mounting engagement with the tip end of each pin tube and has an internal recess with a base surface and an internal peripheral surface. The pin tip member is mounted on the retainer, the outer peripheral surface of the pin tip member engaged with the internal peripheral surface of the retainer and the bottom surface of the pin tip member engaged with the base surface.

This invention details the process and special translating pins for forming honeycomb core through the use of a reconfigurable forming die or dies which do not directly apply heat to the honeycomb core. The forming process consists of adjusting the position of the pins on a reconfigurable forming die or dies (preferably by computer control), (optionally) heating honeycomb core using an oven or other heating means either external to or integral to a forming press, rapidly positioning the honeycomb core relative to the reconfigurable die, pressing the die or dies against the core to impart a three-dimensional contour generally orthogonal to the cells, allowing sufficient time for cooling and/or permanent deformation to occur, and then removing the core from the forming press. Overlap of some of the steps (for example, core heating and positioning of the pins on the adjustable die) is permissible. Either a single adjustable form die or a set of opposing "matched" adjustable dies may be used. If a single adjustable form die is used, the honeycomb core may be pressed into a material (rigid foam, sand, a gas or fluid-filled bladder and/or other conforming or conformable material) which may be contained in a rigid enclosure (open on one end minimally) such that the material and structure can react the forming forces received by the honeycomb core, or the core can be drawn around the reconfigurable die. If matched reconfigurable dies are to be used, the forming process proceeds essentially as before except the honeycomb core is loaded between the two form dies. Conformable pin tips and/or an interpolating pad or layer may be used to help the honeycomb conform to the desired contour without the pin tips causing damage to the honeycomb core cells.

Computer control of the adjustable form die(s) assures better results by tailoring the forming process to the individual job's needs. Algorithms which minimize local core deformations and provide an allowance for "spring back" may be included. This assures that the honeycomb core is formed precisely. Cool air can be introduced at the proper time in the forming cycle to speed up the cooling of the core and/or forming tool as needed for rapid cycling. The entire forming sequence and the individual pin movements can be controlled by a Personal Computer (PC), computer work station, or other computer terminal, preferably one which can support a Graphical User Interface (GUI). The modular design or "building block" approach to discrete tooling can optionally be used to reduce cost and facilitate the manufacturing of larger discrete, reconfigurable tools with respect to repair, maintenance, tolerance build-up, wiring, assembly, and machining processes.

Numerous advantages flow from the present invention. These include:

- much greater versatility (contour changes are made by recalling files from computer memory);
- adaptability to changes (stored data can be "tweaked" as needed by changing pin translational data);
- lower space requirements (no extra fixed-contour dies need to be stored);
- greater production output;
- less down time for contour changes; and
- lower overall tooling cost (many less fixed-contour dies need to be produced).

All result from using the described adjustable, discrete forming apparatus and process compared to presently used fixed-die forming systems and methods when a variety of core shapes must be formed by the same forming machine or press. This invention is readily adaptable to existing presses and is inherently safer and easier since fixed-contour dies do not have to be changed with each different core shape needed.

The forming response of phenolic honeycomb often varies from one production lot to another. Additionally, the forming response of a single production lot can change with seasonal ambient conditions. A reconfigurable forming tool use with a rapid shape measurement system currently being developed permits rapid, inexpensive tool shape changes to correct for differing phenolic honeycomb forming-responses due to variations in production lot or in ambient weather conditions.

When forming a wide-enough variety of honeycomb core shapes that it is advantageous to use a discrete, adjustable form die method over the typical heated core-and-fixed-die method, a modular approach to building larger form dies can offer a lower overall system cost than a non-modular approach. When many modules are assembled in a "building block" approach, lower overall cost is achieved by simplifying wiring, assembly, and machining operations. Inherently lower overall risk is also associated with modularization because this approach reduces the magnitude of errors which cause scrap when creating larger-scale tools. Lower risk in this case translates to lower overall cost. A more consistent and accurately formed core contour can also result from the better temperature control and timing of heat application and removal.

Easier servicing, easier component replacement, and less down time result when using the modular "building block" approach described herein. Individual modules utilize quick-disconnect electrical plugs, and rapid cross shaft gearing connections (for the "Individual Clutch" drive system type) so that module replacement can be accomplished with minimum down time. Individual module repair and/or service can then take place off-line.

Still greater versatility can be achieved by inexpensively allowing overall tool plan form size changes. The overall plan form (length and width) dimensions of the active forming area can be changed when using the modular "building block" units to create adjustable form tools. Modules can easily be added or subtracted within the limitations allowed by the overall form tool base plate. The base plate can have printed circuitry, electrical connectors, pre-installed wiring, and/or bus bars for motor power, logic, and communication between modules and between modules and computer(s), all using common parts to lower assembly time and cost. Framing members (if used) around the die assembly may have to be changed, but their cost would be low compared to replacement of an entire large adjustable form tool.

This invention can also claim all of the advantages of adjustable tooling. Many fixed-contour dies can be replaced when using the methodology described herein. This represents a significant tooling savings as well as savings in storage space, handling, repair, maintenance and rework of fixed dies.

Lastly, the methodology described herein can be applied to room temperature honeycomb core forming (for example, of aluminum honeycomb core) as well as hot forming of Nomex™, graphite, fiberglass, and other nonmetallic honeycomb. The described hardware can also be used to retrofit old fixed-die presses.

Many possible variations in the forming apparatus are allowed for in this invention depending upon the type of pin drive system used (clutch, individual motor, hydraulic, externally-set, and the like) the type of pin tips used (conformable, non-conformable, or pressurized contour-changing type) and whether or not the core needs to be heated. In all applications, if heating of the honeycomb core is needed, it is done external to the form die. When using an individual motor drive system, either a stepper motor drive or a servo-motor drive with an in-line gear reducer may be used to drive the lead screws of each pin or translating member without using clutches. In the individual clutch method, miniature electromagnetic clutches are used to connect and disconnect rotary motion from an input shaft to lead screws which in turn drive pins or translating members. For larger form dies, modular construction is suggested (aforementioned U.S. Pat. No. 5,954,175 entitled "Modularized Parallel Drivetrain" and U.S. Pat. No. 6,012,314 entitled "Individual-Motor Pin Module"). Note that the number of possible embodiments may be doubled by considering that the die(s) may be configured with only one module each (preferably for the special case of small dies), effectively eliminating the modular design feature. Details of both drive systems may be found in the referenced disclosures.

Other pin drive systems or approaches may be used as well to translate the pins. Another method (used by M.I.T.) uses an external pin setting mechanism which translates from row to row below the die (at the base-end of the pins), using a lead screw or lead screws to translate each pin into position individually or in smaller groups. A hydraulic or manual ram is then used to clamp the pins rigidly from one or more sides after the pins are set into position. Yet another method (used by R.P.I.) translates pins hydraulically using a translating "pin-setting" platen which contacts the pin tips to control the position of the pins as hydraulic valves sequentially close the flow of hydraulic fluid to the cylinders for each pin as the pin nears or reaches it's final position. This method also uses side clamping from a hydraulic or manual ram or rams to lock the pins into position. These two described methods were developed for sheet metal forming, but the pin drive and setting methods could be adapted to honeycomb core using the methodology described herein. In most all cases, computer control is employed to rapidly position the pins so that the surfaces of the tips form the desired three-dimensional surface(s) needed.

The forming process consists of adjusting the position of the pins on a reconfigurable forming die or dies (preferably by computer control), (optionally) heating honeycomb core using an oven or other heating means either external to or integral to a forming press, rapidly positioning the honeycomb core relative to the reconfigurable die, pressing the die or dies against the core to impart a three-dimensional contour generally orthogonal to the cells, allowing sufficient time for cooling and/or permanent deformation to occur, and then removing the core from the forming press. Overlap of some of the steps (for example, core heating and positioning of the pins on the adjustable die) is permissible. Either a single adjustable form die or a set of opposing "matched" adjustable dies may be used. If a single adjustable form die is used, the honeycomb core may be pressed into a material (rigid foam, sand, a gas or fluid-filled bladder and or other conforming or conformable material) which may be contained in a rigid enclosure (open on one end minimally) such that the material and structure can react the forming forces received by the core, or the core may be drawn around the die. If matched reconfigurable dies are to be used, the forming process proceeds essentially as before except the honeycomb core is loaded between the two form dies. Conformable pin tips and/or an interpolating pad or layer may be used to help the honeycomb conform to the desired contour without the pin tips causing damage to the honeycomb core cells. The pins and tips are described separately herein.

Two distinct reconfigurable tooling approaches for forming honeycomb core have been submitted. U.S. application Ser. No. 09/310,664 entitled "Modularized, Reconfigurable, Heated Forming Tool and Method for Honeycomb Core" by E. Haas, R.C. Schwarz, and J. Papazian details a matched-die forming method and apparatus which includes a self-heating capability. U.S. application Ser. No. 09/392,710 entitled "Single-Die, Modularized, Reconfigurable Forming Tool & Method for Honeycomb Core" by E. Haas, R.C. Schwarz, and J. Papazian details a single die forming method and apparatus which includes a self-heating capability. This latter disclosure describes a reconfigurable single or matched-die forming method which externally heats the honeycomb core and may use soft or conformable pin tips to gently form the core without damaging the cells. The combined use of external heating and reconfigurable tooling (especially with conformable pin tips) is clearly non-obvious over prior art. Without the proper combination of hardware & processing described herein, honeycomb core could not be properly formed by simply using reconfigurable tools and external heating without damage to the cells. The disclosures of the abovereferenced applications are also hereby incorporated into this disclosure in their entirety by reference.

When the modular construction approach has been taken and a larger die plan form is needed, adjusting the size of the form die or dies can easily be done by adding or subtracting modules within the limitations allowed by the overall form tool base plate. The base plate can have printed circuitry, electrical connectors, pre-installed wiring, and bus bars for motor power, logic, and communication between modules and between modules and computer(s).

It should be noted that one or more form dies may be attached to a movable ram(s) of a forming press whereby one or more external hydraulic cylinders, screw jack type devices (not shown), or other translational means may be used to move the discrete-pin, adjustable form die(s). Or if a single die is used, it could be attached to a fixed platen, with the opposing platen movable. The adjustable form die could also (less desirably) be used without a forming press, using the translating pins to provide all of the movement. Either horizontal, vertical, or any angular orientation can be used for the die(s). Press-type forming methods are well known in the art. The adaptation of the invention embodiments described herein is dependent upon the particular press, the adaptation techniques are well known to those of ordinary skill in the art. They are therefore not shown specifically. Hydraulic, pneumatic, screw-type drive presses, or even a fixed rigid structure (whereby the pin movement alone is used for forming) may therefore be used without changing the spirit of the invention embodiments described.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
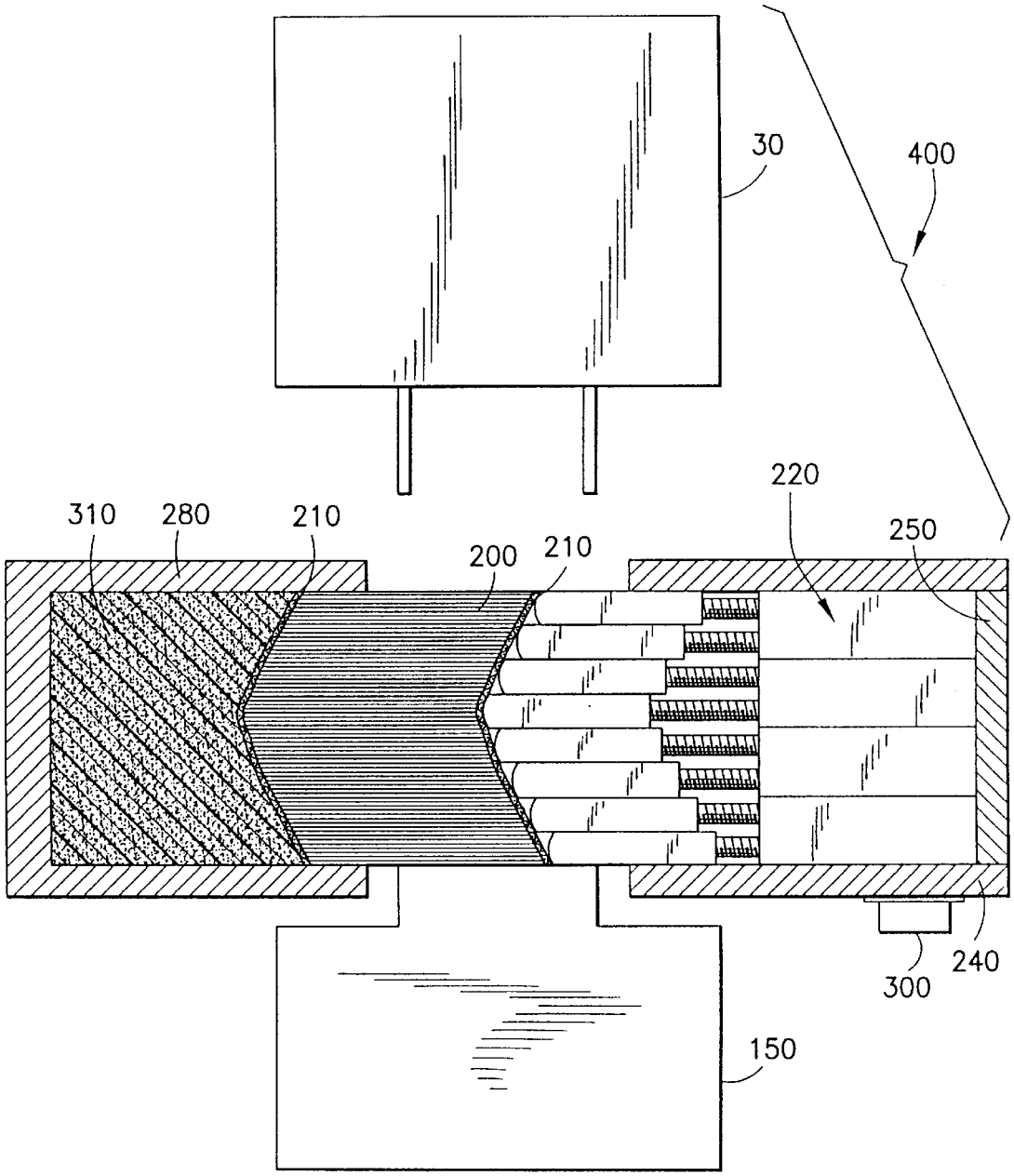
FIG. 1 is an elevation view of apparatus embodying the invention in the form of a single reconfigurable die in a horizontal orientation with certain parts broken away and shown in section for clarity.
Figure 2:
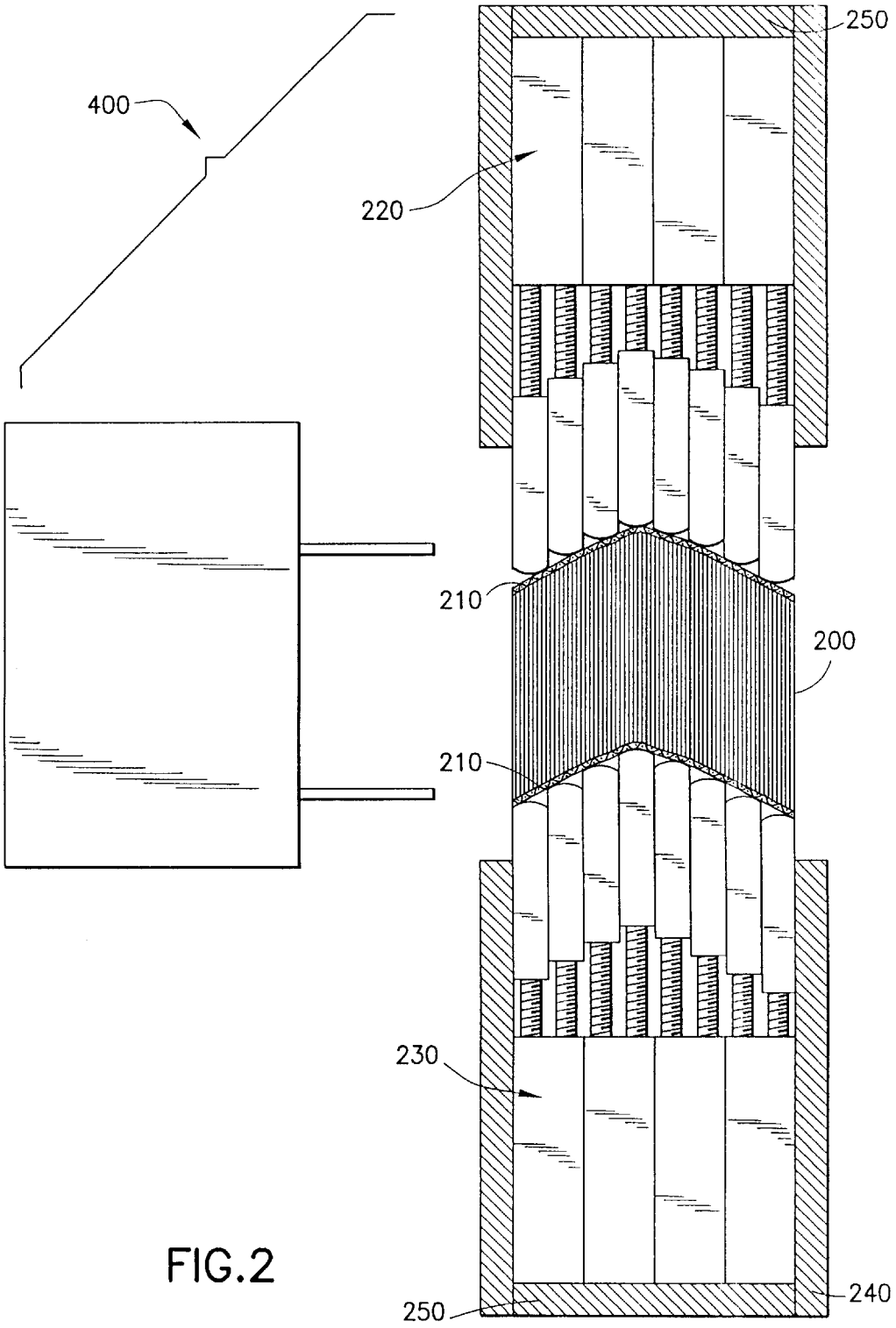
FIG. 2 is an elevation view of the apparatus of FIG. 1 in a vertical orientation with certain parts broken away and shown in section for clarity and depicting a matched reconfigurable die forming a piece of honeycomb core.
Figure 3:
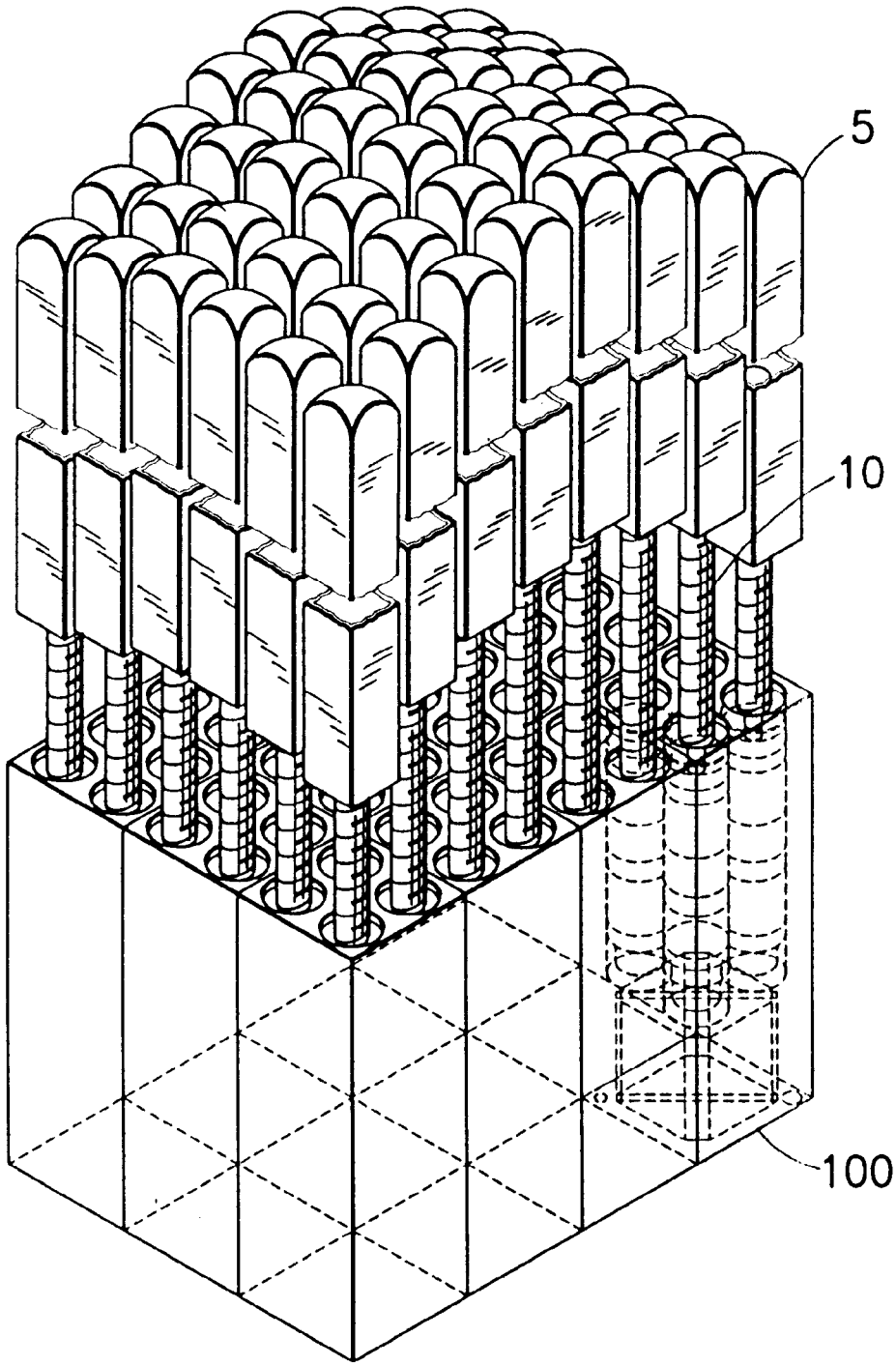
FIG. 3 is a perspective view of a discrete-pin, reconfigurable forming die employed in the apparatus illustrated in FIGS. 1 and 2.

Referring to FIGS. 1 and 2, there is shown in horizontal and vertical orientations, respectively, tooling apparatus 400 embodying the invention in the form of a single reconfigurable die incorporating features of the present invention. Although the present invention will be described with reference to the single embodiment shown in the drawings, it should be understood that the present invention can be embodied in many alternate forms of embodiments. For example, the tooling apparatus 400 may readily be modified to be in the form of double or opposed reconfigurable dies. In addition, any suitable size, shape or type of elements or materials could be used.

The forming of honeycomb core is generally limited to the aerospace industry where a large number of honeycomb core details are used to build contoured, strong, highly weight-efficient structures. In the aerospace industry, each aircraft (or spacecraft) requires many pieces of formed honeycomb core, and the number of formed details is large relative to the amount of planes produced for a given year. A process that can quickly and easily adapt to produce small quantities each of many different honeycomb core details therefore is well suited to the aerospace industry. Similarly, other aerospace-related components (e.g. thermoplastic components) which utilize cold or hot forming techniques or presses are candidates for the hardware and method described herein. Within the aerospace industry, single and matched-die forming tools may be used to fabricate both sheet metal and thermoplastic parts Sheet metal parts generally require higher forming forces and may require non-conformable pin tips and an interpolating layer as described in prior referenced disclosures. Thermoplastic sheets can be contour-formed using the described invention if the forming temperatures are within the thermal limit of the tools design and design accommodations are made. Thin gage aluminum sheet metal details could also be formed using this process, although the quality of the resulting parts may not be as high as with present processes.

Other industries in addition to the aerospace industry that need to hold, form, or inspect contoured components can also benefit from the tooling or methodology described herein. The translating pins can be used to hold three-dimensionally contoured parts or components. The pins can also translate a series of sensors for rapidly digitizing the surface(s) of a contoured part or component by replacing the pin tips with tips specially configured to hold sensors or other devices. The digitized data can be directly stored in computer memory for a three-dimensional surface description which can be used by a computer-graphic or numerical control software application. This would give the tooling utilized by this process the ability to create three-dimensional data and/or pin translational data directly from three-dimensional models (for example, from stereo lithography). Modular construction adds the ability to isolate and rapidly replace malfunctioning elements by replacing entire modules with spare, off-the-shelf modules. Further repairs can then be implemented off-line. This minimizes down time, and replacement cost. The ability to reconfigure an entire assembly of modules by adding or subtracting modules gives a high degree of versatility from which other forming processes might also benefit.

Many possible variations in the forming apparatus are allowed for in this invention depending upon the type of pin drive system used (clutch, individual motor, hydraulic, externally-set, and the like), the type of pin tips used (conformable, non-conformable, or pressurized contour-changing type), and whether or not the core needs to be heated. In all applications, if heating of the honeycomb core is needed, it is done external to the form die. When using an individual motor drive system, either a stepper motor drive or a servo-motor drive with an in-line gear reducer may be used to drive the lead screws of each pin or translating member without using clutches. In the individual clutch method, miniature electromagnetic clutches are used to connect and disconnect rotary motion from an input shaft to lead screws which in turn drive pins or translating members. For larger form dies, modular construction is suggested (reference the disclosures in aforementioned U.S. Pat. No. 5,954,175 entitled "Modularized Parallel Drivetrain" and U.S. Pat. No. 6,012,314 entitled "Individual-Motor Pin Module". Note that the number of possible embodiments may be doubled by considering that the die(s) may be configured with only one module each (preferably for the special case of small dies), effectively eliminating the modular design feature. Details of both drive systems may be found in the referenced disclosures.

Other pin drive systems or approaches may be used as well to translate the pins. Another method uses an external pin setting mechanism which translates from row to row below the die (at the base-end of the pins), using a lead screw or lead screws to translate each pin into position individually or in smaller groups. A hydraulic or manual ram is then used to clamp the pins rigidly from one or more sides after the pins are set into position. Yet another method translates pins hydraulically using a translating "pin-setting" platen which contacts the pin tips to control the position of the pins as hydraulic valves sequentially close the flow of hydraulic fluid to the cylinders for each pin as the pin nears or reaches it's final position. This method also uses side clamping from a hydraulic or manual ram or rams to lock the pins into position. In most instances, computer control is employed to rapidly position the pins so that the surfaces of the tips form the desired three-dimensional surface(s) needed.

The forming process includes adjusting the position of the pins on a reconfigurable forming die or dies (preferably by computer control), optionally heating honeycomb core using an oven or other heating mechanism either external to or integral to a forming press, rapidly positioning the honeycomb core relative to the reconfigurable die, pressing the die or dies against the core to impart a three-dimensional contour generally orthogonal to the cells, allowing sufficient time for cooling and/or permanent deformation to occur, and then removing the core from the forming press. Overlap of some of the steps, for example, core heating and positioning of the pins on the adjustable die, is permissible. Either a single adjustable form die or a set of opposing "matched" adjustable dies may be used. If a single adjustable form die is used, the honeycomb core may be pressed into a material (rigid foam, sand, a gas or fluid-filled bladder and or other conforming or conformable material) which may be contained in a rigid enclosure (open on one end minimally) such that the material and structure can react the forming forces received by the core, or the core may be drawn around the die. If matched reconfigurable dies are to be used, the forming process proceeds essentially as before except the honeycomb core is loaded between the two form dies. Conformable pin tips and/or an interpolating pad or layer may be used to help the honeycomb conform to the desired contour without the pin tips causing damage to the honeycomb core cells. The pins and tips are described separately herein.

A description of two reconfigurable tooling approaches for forming honeycomb core is provided in the disclosures of U.S. applications: Ser. No. 09/310,664 entitled "Modularized, Reconfigurable, Heated Forming Tool and Method for Honeycomb Core" by E. Haas, R.C. Schwarz, and J. Papazian and Ser. No. 09/392,710 entitled "Single-Die, Modularized, Reconfigurable Forming Tool & Method for Honeycomb Core" by E. Haas, R.C. Schwarz, and J. Papazian, both of which includes a self-heating capability. This disclosure describes a reconfigurable single or matched-die forming method which externally heats the honeycomb core and may use soft or conformable pin tips to gently form the core without damaging the cells. The combined use of external heating and reconfigurable tooling (especially with conformable pin tips) is clearly non-obvious over prior art. Without the proper combination of hardware & processing described herein, honeycomb core could not be properly formed by simply using reconfigurable tools and external heating without damage to the cells.

When the modular construction approach (per the disclosures in aforementioned U.S. Pat. No. 5,954,175 entitled "Modularized Parallel Drivetrain" and U.S. Pat. No. 6,012,314 entitled "Individual-Motor Pin Module") has been taken and a larger die plan form is needed, adjusting the size of the form die or dies can easily be done by adding or subtracting modules within the limitations allowed by the overall form tool base plate. The base plate can have printed circuitry, electrical connectors, pre-installed wiring, and bus bars for motor power, logic, and communication between modules and between modules and computer(s).

It should be noted that one or more form dies may be attached to a movable ram(s) of a forming press whereby one or more external hydraulic cylinders, screw jack type devices (not shown), or other translational means may be used to move the discrete-pin, adjustable form die(s). Or if a single die is used, it could be attached to a fixed platen, with the opposing platen movable. The adjustable form die could also (less desirably) be used without a forming press, using the translating pins to provide all of the movement. Either horizontal, vertical, or any angular orientation can be used for the die(s). Press-type forming methods are well known in the art. The adaptation of the invention embodiments described herein is dependent upon the particular press, the adaptation techniques are well known to those of ordinary skill in the art. They are therefore not shown specifically. Hydraulic, pneumatic, screw-type drive presses, or even a fixed rigid structure, whereby the pin movement alone is used for forming, may therefore be used without changing the spirit of the invention embodiments described.

The functioning of the present invention is similar to both the formerly mentioned inventions disclosed in U.S. applications: Ser. No. 09/310,664 entitled "Modularized, Reconfigurable, Heated Forming Tool and Method for Honeycomb Core" by E. Haas, R.C. Schwarz, and J. Papazian and Ser. No. 09/392,710 entitled "Single-Die, Modularized, Reconfigurable Forming Tool & Method for Honeycomb Core" by E. Haas, R.C. Schwarz, and J. Papazian. except that hot air or gas does not pass through the pins or translating members 5. Heat, if used, is externally applied via an oven or heating means 30 with vertical part exit capability or 40 with horizontal part exit capability. Although the specific operating and design details of the afore-mentioned co-pending patent applications are hereby included by reference, the features and methods in those disclosures which deal with the self-heating capability are not present in the present construction. Reconfigurable tooling has been described in several pending and issued U.S. patent applications including U.S. Pat. No. 4,212,188 issued to George T. Pinson entitled "Apparatus for Forming Sheet Metal". The specific details of how to use reconfigurable tooling for forming honeycomb core 200, especially in a way that can be adapted to existing equipment, however, are not suggested by any known references. Prior to this disclosure, the lack of the methodology had made the use of reconfigurable tooling for forming honeycomb core commercially unacceptable. Low-cost computer memory and computation capability, the use of a modular approach, conformable pin tips, and the procedure below cohesively tie all of the needed components together. These steps include:

1. obtaining and storing a mathematical or graphical contour description of the final three-dimensional contour to be imparted to the honeycomb core;
2. determining the position of each pin in order to best form the honeycomb core to the desired three dimensional contour. This should be done by computer algorithm(s). To speed up the time period for adjusting the die contour to properly account for honeycomb core springback, a special algorithm (or algorithms) may be used to adjust the dies' shape to account for springback;
3. converting the positional information for the location of each pin into a signal or signals which elicit the desired pin-translational result from the form die. This can be a series of timed "apply" signals to activate miniature electromagnetic clutches, a series of electrical pulses sent to activate electric motors (stepper, servo, or other) or their controllers, or a series of signals to apply or release hydraulic control valves;

4. translating the appropriate pins of the reconfigurable die(s) to the proper position to form the contoured forming surfaces(s) using pins having conforming or conformable tips. This step can occur concurrently with the prior step;
5. optionally heating, if necessary, the honeycomb core by a heat source external to the form die(s), followed by immediate positioning of the core relative to the die(s). Note: Steps 4 and 5 can overlap, occur concurrently, or in the described sequence;
6. forming of the core via movement of the pins and/or die(s) such that the honeycomb core is forced to take the desired shape as created by the external pin surfaces of the die(s);
7. holding of the core in the formed position for a sufficient time period for permanent deformation to take place; and
8. removing the core from the forming tool.

The process may be restarted using new "Step 1" data from a shape measurement system. Although these generic steps, in hindsight, may seem somewhat obvious, their combination has come after much effort has been put into forming honeycomb core by many other methods. Relative to sheet metal forming, honeycomb core is relatively fragile and requires relatively light forming forces. Much undesirable cell damage might occur when attempting to form honeycomb core directly with reconfigurable tools having pin tips of previously known construction. Interpolating material 210 can be added as suggested; however, an interpolating pad may itself require pre-forming to function properly, thus defeating the major objective of reconfigurable tooling: the replacement of fixed contour tools. An additional operational feature may be added prior to step 4, namely, the conformable or conforming pin tip assemblies 50 may be easily replaced as needed to adapt to different honeycomb core 200 configurations, or as needed due to wear, damage, or for maintenance reasons.

The "soft" or conformable pin tip assemblies 50 are a key part of this invention. Indeed, the invention includes a pair of integrated inventive concepts, namely, the conformable pin tip assemblies 50 and the methodology described. In this regard, the optimum honeycomb core 200 forming results are achieved with a combination of the method and the use of conformable tip assemblies 50 as described herein.

Figure 4:
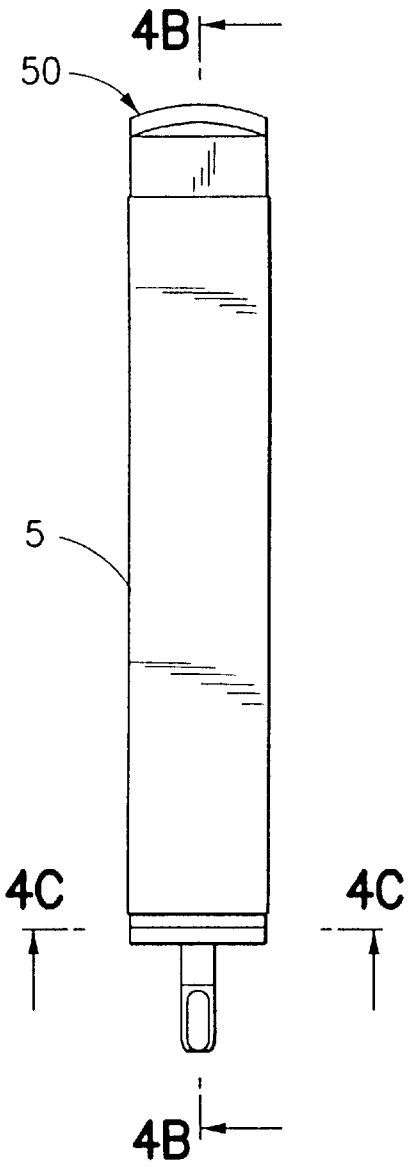
FIG. 4 is a detail elevation view illustrating a pin assembly utilized by the invention of the lead screw type that employs conforming or conformable pin tips to form the honeycomb core without damaging the cell walls.
Figure 5:
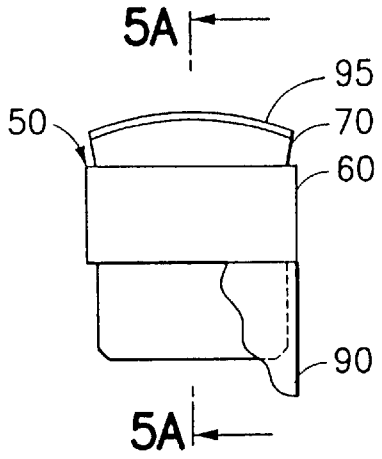
FIG. 5 is a detail elevation view illustrating a pin tip member utilized by the invention which can conform to different shapes as needed for forming different honeycomb core contours.
Figure 6:
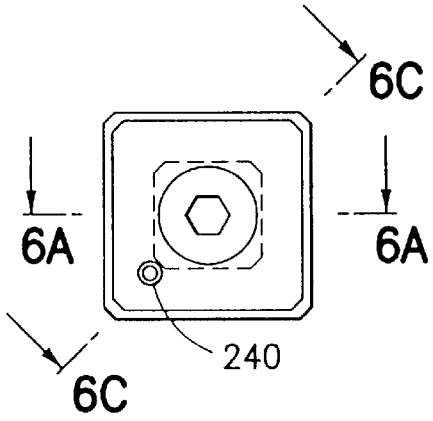
FIG. 6 is a bottom plan view of a single pin tip assembly of the type that changes contour when internally pressurized.
Figure 6B:
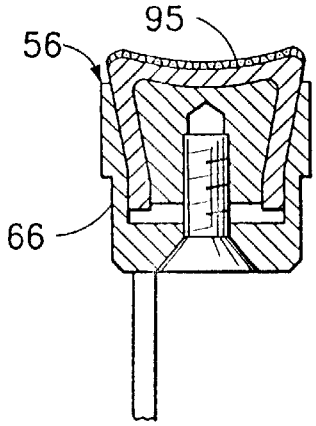
FIGS. 6A and 6B are cross section views taken generally along line 6A—6A, the former to illustrate the pressurized condition, the latter to illustrate the deflated condition.
Figure 6A:
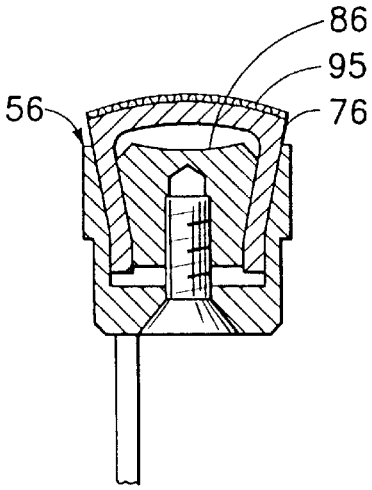
Figure 6C:
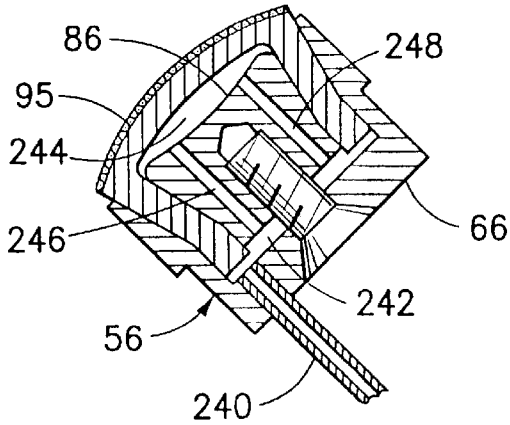
FIG. 6C is a cross-section view taken generally along line 6C—6C in FIG. 6 to illustrate the pressurized condition.

Referring to FIGS. 4, 5, and 6, a single translating pin or member assembly 5 is shown to illustrate how the conformable pin tip assemblies 50 may be attached to the pin tube 90 portion of the pin assemblies 5. Several versions of the pin tip assemblies 50 are shown in FIGS. 5 and 6. For example, pin tip assembly 51 includes an elongated pin tip member 224 having an outwardly projecting bearing surface 202 of shape conformable material, an opposed bottom surface 228, and an outer peripheral surface 226 extending between the outwardly projecting bearing surface and the opposed bottom surface. A protective thrust pad 95 is suitably mounted on and conforms to the outwardly projecting bearing surface 202 of the elongated pin tip member 224.

The pin tip assembly 51 uses a fastener 211 which is passed through a base 212 of a cup-shaped retainer 214 also having an upstanding wall 216 with an outer peripheral surface 218 for mounting engagement with the tip end of a pin tube 90 and an internal recess having a base surface 221 and an internal peripheral surface 222. The pin tip member 224 is mounted on the retainer 214, an outer peripheral surface 226 of the pin tip member engaged with the internal peripheral surface 222 of the retainer 214 and a bottom surface 228 of the pin tip member proximate the base surface 221. The fastener 211 is threaded into a vented pin tip plug 81 of elastic or compliant material for retention of the latter on the retainer 214. The outwardly projecting portion, or surface 202, of the pin tip member 224 is of a generally spherical or arcuate configuration. The high-shear conformable material 95 may be attached to each compliant pin tip member to prevent it from being damaged by the honeycomb core 200 during the forming operation. Note that the high-shear conformable material 95 shown may comprise one or more layers of screen, cloth, mesh, or any combination of materials as long as the aggregate can conform to the geometry of its associated pin tip and prevent the honeycomb core 200 from damaging the pin tip material.

Figure 5A:
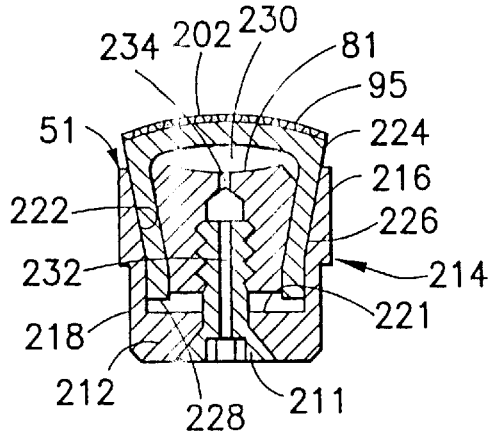
FIG. 5A is a cross section view taken generally along line 5A—5A.

With continuing reference to FIG. 5A, the pin tip member 224 has a cavity intermediate the head element, that is, the outwardly projecting portion, or surface 202 and the plug 81 and the fastener 210 and the plug have mutually connecting bores 232, 234 communicating with the cavity enabling the cavity to vent to the atmosphere. As is evident from FIG. 5A, the internal peripheral surface of the retainer 214 is divergent with increased distance from the base surface 221 and the pin tip member 224 includes a resilient cap member having a head element and an integral downwardly projecting skirt defining an internal cavity 230. The plug 81 has a tapered outer peripheral surface conforming generally with the internal peripheral surface 222 of the retainer and is received within the internal cavity 230. The fastener 210, as earlier noted, is threadedly engaged with the plug 81 for drawing the plug toward the base surface 221 and for firmly gripping the skirt of the pin tip member between the outer peripheral surface of the plug and the upstanding wall of the retainer.

Figure 5B:
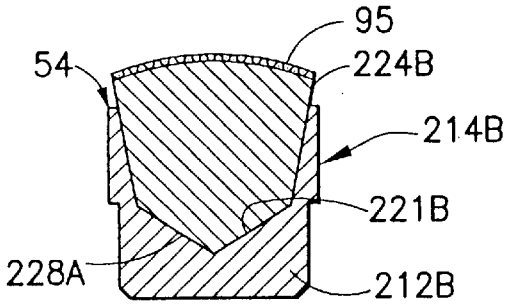
FIG. 5B is a cross section view similar to FIG. 5A but illustrating another embodiment of pin tip member.
Figure 5C:
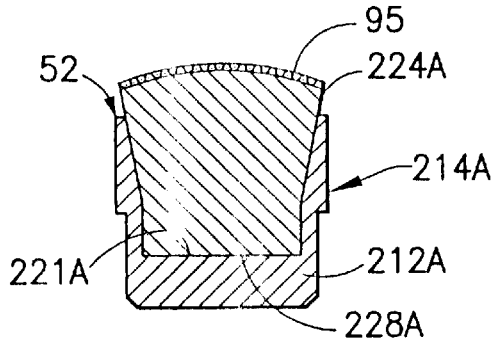
FIG. 5C is a cross section view similar to FIG. 5A but illustrating still another embodiment of pin tip member.

FIGS. 5C and 5B show two different configurations of pin tip assemblies 52 and 54, respectively, which use solid, conforming or conformable pin tips 72 and 74 respectively.

As seen in FIG. 5C, a bottom surface 228A of the pin tip member 224A is engaged with a base surface 221A of the retainer 214A and the bottom surface of the pin tip member and the base surface of the retainer are substantially flat. As seen in FIG. 5B, a bottom surface 228A of the pin tip member 224B is engaged with a base surface 221B of the retainer 214B and the bottom surface of the pin tip member and the base surface of the retainer are conically shaped.

Figure 5D:
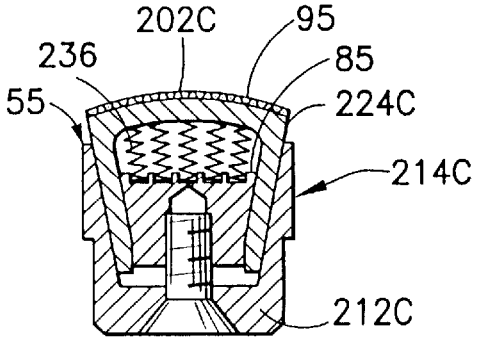
FIG. 5D is a cross section view similar to FIG. 5A but illustrating yet another embodiment of pin tip member.

Turning now to FIG. 5D, the pin tip member 224C has a cavity intermediate the head element, that is, the outwardly projecting portion, or surface 202C and the plug 85 and a plurality of compression springs extend between the head element and the plug urging the head element to assume a convex contour.

Figure 5E:
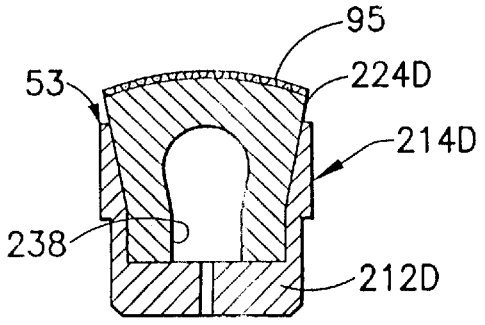
FIG. 5E is a cross section view similar to FIG. 5A but illustrating another embodiment of pin tip member.

A hollow pin tip assembly 53 is shown in FIG. 5E which is similar to the "soft" pin tip assembly of FIG. 5C except for the inclusion of an internal cavity 238. An adhesive (not shown) may be used to secure the pin tips 224, 224A, 224B, 224C, and 224D to the pin tip bases 212, 212A, 212B, 212C, and 212D, respectively, in each of the configurations.

A conformable pressurized pin tip assembly 56 is shown in FIG. 6. In this design, concave pin tip members 76 may be installed using a pressure balancing pin tip plug 86, fastener, adhesive and/or sealant (not shown) to insure that no gas leakage from the pressurized pin tip assembly 56 occurs. A tube 240 is connected to a through-passage 242 in the base 66 for supplying pressurized gas to the cavity 244 located within the pin tip member 76. One or more pressure balancing passages 246, 248 may be included in the pressure-balancing pin tip plug 86 to transfer the pressurized gas such that the cavity 244 is formed directly underneath the pin tip 76.

Figure 4B:
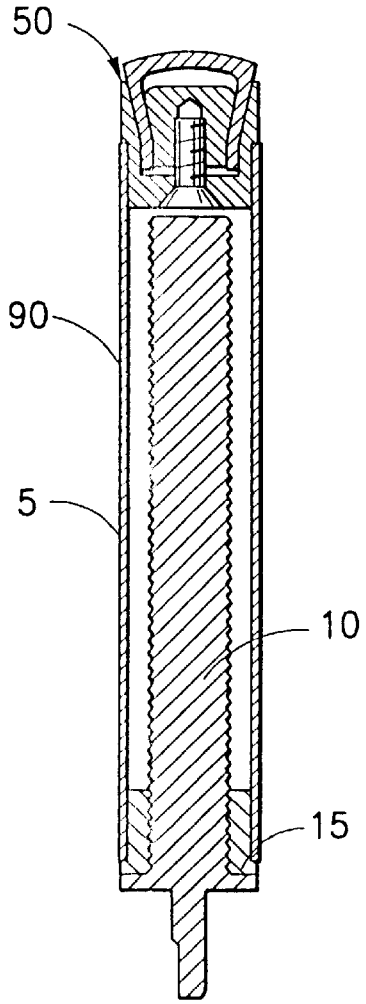
FIG. 4B is a cross-section view taken generally along line 4B—4B in FIG. 4.
Figure 4A:
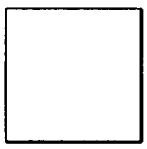
FIG. 4A is an end view of the pin assembly illustrated in FIG. 4.
Figure 4C:
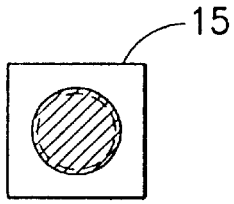
FIG. 4C is a cross-section view taken generally along line 4C—4C in FIG. 4.

The pin tip assemblies 61 though 56 can be used with any type of pin tube 90 such that a translating pin or member assembly 5 is formed. Although FIG. 4B is shown basically as square, any geometric shape may be used. Round hollow pin tubes 90 are generally used for hydraulically actuated pins, and hollow rectangular or hexagonal pin tubes 90 are also available. Other extrusion shapes are also available and can be used without changing the spirit of the invention. Different pin tip 70 external geometries can be used as required by the geometric needs of the honeycomb core 200 to be formed. The ability to rapidly change these pin tip assemblies 50 inherent in this design cannot be overemphasized.

It may be noted that the conformable pin tips themselves with or without the pin assemblies 5 may be separated to form its own series of inventions when used in combination with the other references.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In tooling apparatus for three-dimensionally forming a honeycomb core article including a die having an array of elongated mutually parallel translating pins, each having a pin tube terminating at a tip end and arranged in a matrix for longitudinal movement between retracted and extended positions, the tip ends of the array of translating pins being engageable with an end surface of the honeycomb core article when in the extended position, each tip end including a pin tip assembly comprising:

an elongated pin tip member having an outwardly projecting bearing surface of shape conformable material, an opposed bottom surface, and an outer peripheral surface extending between the outwardly projecting bearing surface and the opposed bottom surface; and a protective thrust pad mounted on and conforming to the outwardly projecting bearing surface of the elongated pin tip member; and a cup-shaped retainer having a base and an upstanding wall with an outer peripheral surface for mounting engagement with the tip end of a pin tube and an internal recess having a base surface and an internal peripheral surface, the pin tip member mounted on the retainer, the outer peripheral surface of the pin tip member engaged with the internal peripheral surface of the retainer and the bottom surface of the pin tip member engaged with the base surface.

2. Tooling apparatus as set forth in claim 1 wherein the outwardly projecting bearing surface is convex.

3. Tooling apparatus as set forth in claim 1 wherein the bottom surface is engaged with the base surface of the retainer, and wherein the bottom surface of the pin tip member and the base surface of the retainer are substantially flat.

4. Tooling apparatus as set forth in claim 1 wherein the bottom surface is engaged with the base surface of the retainer, and wherein the bottom surface of the pin tip member and the base surface of the retainer are conically shaped.

5. Tooling apparatus as set forth in claim 3 wherein the pin tip member has an internal cavity; and wherein the base has a through-bore communicating with the internal cavity of the pin member.

6. Tooling apparatus as set forth in claim 1 wherein the internal peripheral surface of the retainer is divergent with increased distance from the base surface; and wherein the pin tip member includes:

a resilient cap member having a head element and an integral downwardly projecting skirt defining an internal cavity;

a plug having a tapered outer peripheral surface conforming generally with the internal peripheral surface of the retainer, the plug received within the internal cavity of the cap member; and a fastener on the base of the retainer threadedly engaged with the plug for drawing the plug toward the base surface and firmly gripping the skirt between the outer peripheral surface of the plug and the upstanding wall of the retainer.

7. Tooling apparatus as set forth in claim 6 wherein the pin tip member has a cavity intermediate the head element and the plug; and a plurality of compression springs extending between the head element and the plug urging the head element to assume a convex contour.

8. Tooling apparatus as set forth in claim 6 wherein the pin tip member has a cavity intermediate the head element and the plug; and wherein the fastener and the plug have mutually connecting bores communicating with the cavity enabling the cavity to vent.

9. Tooling apparatus as set forth in claim 6 wherein the pin tip member has a first cavity intermediate the head element and the plug and a second cavity intermediate the plug and the base of the retainer;

wherein the plug has at least one passage extending from the first cavity to the second cavity; and including a source of pressurized fluid; and a conduit connecting the source of pressurized fluid to the second cavity.

10. A pin tip assembly for use with tooling apparatus for three-dimensionally forming a honeycomb core article including a die having an array of elongated mutually parallel translating pins, each having a pin tube terminating at a tip end and arranged in a matrix for longitudinal movement between retracted and extended positions, the tip ends of the array of translating pins being engageable with an end surface of the honeycomb core article when in the extended position, the pin tip assembly comprising:

an elongated pin tip member having an outwardly projecting bearing surface of shape conformable material, an opposed bottom surface, and an outer peripheral surface extending between the outwardly projecting bearing surface and the opposed bottom surface;

a protective thrust pad mounted on and conforming to the outwardly projecting bearing surface of the elongated pin tip member;

a cup-shaped retainer having a base and an upstanding wall with an outer peripheral surface for mounting engagement with the tip end of a pin tube and an internal recess having a base surface and an internal peripheral surface, the pin tip member mounted on the retainer, the outer peripheral surface of the pin tip member engaged with the internal peripheral surface of the retainer and the bottom surface of the pin tip member engaged with the base surface.

11. Tooling apparatus as set forth in claim 10 wherein the outwardly projecting bearing surface is convex.

12. A pin tip assembly as set forth in claim 10 wherein the bottom surface is engaged with the base surface of the retainer, and wherein the bottom surface of the pin tip member and the base surface of the retainer are substantially flat.

13. A pin tip assembly as set forth in claim 10 wherein the bottom surface is engaged with the base surface of the retainer, and wherein the bottom surface of the pin tip member and the base surface of the retainer are conically shaped.

14. A pin tip assembly as set forth in claim 10 wherein the pin tip member has an internal cavity; and wherein the base has a through-bore communicating with the internal cavity of the pin member.

15. A pin tip assembly as set forth in claim 10 wherein the internal peripheral surface of the retainer is divergent with increased distance from the base surface; and wherein the pin tip member includes:

a resilient cap member having a head element and an integral downwardly projecting skirt defining an internal cavity;

a plug having a tapered outer peripheral surface conforming generally with the internal peripheral surface of the retainer, the plug received within the internal cavity of the cap member; and a fastener on the base of the retainer threadedly engaged with the plug for drawing the plug toward the base surface and firmly gripping the skirt between the outer peripheral surface of the plug and the downwardly projecting skirt of the retainer.

16. A pin tip assembly as set forth in claim 15 wherein the pin tip member has a cavity intermediate the head element and the plug; and a plurality of compression springs extending between the head element and the plug urging the head element to assume a convex contour.

17. A pin tip assembly as set forth in claim 15 wherein the pin tip member has a cavity intermediate the head element and the plug; and wherein the fastener and the plug have one or more mutually connecting bores communicating with the cavity enabling the cavity to vent.

18. A pin tip assembly as set forth in claim 15 wherein the pin tip member has a first cavity intermediate the head element and the plug and a second cavity intermediate the plug and the base of the retainer;

wherein the plug has at least one passage extending from the first cavity to the second cavity; and including a source of pressurized fluid; and a conduit connecting the source of pressurized fluid to the second cavity.

19. Tooling apparatus for three-dimensionally forming a honeycomb core article having first and second opposed end surfaces comprising:

a die including an array of elongated mutually parallel translating pins terminating at a tip end and arranged in a matrix for longitudinal movement between retracted and extended positions;

a stationary member of resilient composition including a receiving surface facing and laterally coextensive with said tip ends of said translating pins;

said die and said stationary member adapted to receive the honeycomb core article therebetween, said tip ends of said array of translating pins being engageable with the first end surface of the honeycomb core article, said receiving surface of said stationary member being engageable with the second end of the honeycomb article; and a controller for moving individually each of said array of translating pins in a coordinated manner between the retracted and extended positions and into engagement with the first end surface of the honeycomb core article to thereby impart a desired contour to the first end surface while simultaneously urging the second end surface of the honeycomb core article into engagement with the receiving surface of said stationary member whereby a contour is imparted to the second end surface which is substantially similar to that of the first end surface;

each tip end of the array of translating pins including a pin tip assembly comprising:

an elongated pin tip member having an outwardly projecting bearing surface of shape conformable material, an opposed bottom surface, and an outer peripheral surface extending between the outwardly projecting bearing surface and the opposed bottom surface;

a protective thrust pad mounted on and conforming to the outwardly projecting bearing surface of the elongated pin tip member; and a cup-shaped retainer having a base and an upstanding wall with an outer peripheral surface for mounting engagement with the tip end of a pin tube and an internal recess having a base surface and an internal peripheral surface, the pin tip member mounted on the retainer, the outer peripheral surface of the pin tip member engaged with the internal peripheral surface of the retainer and the bottom surface of the pin tip member engaged with the base surface.

* * * * *